US005797767A

United States Patent [19]

Schell

[11] Patent Number: 5,797,767

[45] Date of Patent: Aug. 25, 1998

[54] INDICATOR LIGHT MODULAR JACK

[75] Inventor: Mark S. Schell, Palatine, Ill.

[73] Assignee: Berg Technology, Inc., Reno, Nev.

[21] Appl. No.: 657,792

[22] Filed: May 31, 1996

[51] Int. Cl.[6] ..... H01R 3/00

[52] U.S. Cl. ..... 439/490; 439/329

[58] Field of Search ..... 439/77, 78, 79, 439/489, 490, 329

[56] References Cited

U.S. PATENT DOCUMENTS

| | | | |
|---|---|---|---|
| 3,647,986 | 3/1972 | Lace et al. | 179/100.2 CA |
| 3,819,928 | 6/1974 | Kuroyama et al. | 240/2 S |
| 3,942,859 | 3/1976 | Korodi | 339/113 L |
| 4,255,780 | 3/1981 | Sakellaris | 362/32 |
| 4,379,606 | 4/1983 | Clark et al. | 339/17 CF |
| 4,397,513 | 8/1983 | Clark et al. | 339/91 R |
| 4,504,830 | 3/1985 | Boehme | 340/815.31 |
| 4,924,213 | 5/1990 | Decho et al. | 340/653 |
| 4,978,317 | 12/1990 | Pocrass | 439/490 |
| 4,993,803 | 2/1991 | Suversion et al. | 350/96.2 |
| 5,067,785 | 11/1991 | Schirbl et al. | 385/38 |
| 5,194,010 | 3/1993 | Dambach et al. | 439/79 |
| 5,239,983 | 8/1993 | Katsurada | 128/6 |
| 5,242,315 | 9/1993 | O'Dea | 439/577 |
| 5,277,615 | 1/1994 | Hastings et al. | 439/377 |
| 5,327,328 | 7/1994 | Simms et al. | 362/26 |
| 5,359,492 | 10/1994 | Porter | 361/683 |

FOREIGN PATENT DOCUMENTS

| | | | |
|---|---|---|---|
| 3637191 C1 | 9/1987 | Germany | H01R 13/717 |

*Primary Examiner*—Khiem Nguyen

*Attorney, Agent, or Firm*—Bruce J. Bowman; Daniel J. Long; M. Richard Page

[57] ABSTRACT

A modular jack includes a removable face plate or front shield that is adapted to removably retain line status LEDs. In the preferred form, the face plate may be used to retrofit standard dual receptacle modular jacks. The face plate holds various types of LEDs that are electrically coupled to the lines of the modular jack for indicating status or activity of the particular line, e.g. when the line is in use transmitting or receiving data. The LEDs may be coupled to the individual lines by standard leads or flexible ribbon cable. Additionally, the face plate is formed of a metal to provide protection against static discharge damage to the circuits. The metal face plate provides an alternative path for the electricity rather than through the LED which might cause damage thereto. In another form, the LEDs may be directly coupled to a flex circuit, without a face plate with the flex coupled to the individual lines. The flex circuit may extend about the housing of the jack and be secured thereto by a suitable adhesive.

9 Claims, 4 Drawing Sheets

INDICATOR LIGHT MODULAR JACK

FIELD OF THE INVENTION

The present invention relates to modular jacks and, more particularly, to modular jacks having line status indicators.

BACKGROUND OF THE INVENTION

Modular jacks are well known, especially for telephone communications equipment wherein it is necessary to provide a releasable coupling of one device to another. Modular jacks are frequently used for the interconnection of computing devices to the telephone system, as they provide a compact, cost effective, and user friendly interface. The modular jacks releasably connect four and in some cases six or more discrete lines or circuits from one device to another via a complementary plug. Single or multiple (gang) jacks are made that couple single or multiple lines to single or multiple line devices.

In some applications, it has become necessary to monitor or inform a user of the electrical activity on one or more of the jack's circuits. Such activity could be the use of the line or a trouble indication. In the prior art, this is usually accomplished by mounting an indicator light close to or adjacent to the jack and electrically coupling the light to the circuit. While this is at least adequate for single or individual jacks, this practice is quite cumbersome concerning multiple jacks.

In U.S. Pat. No. 4,978,317, entitled Connector With Visual Indicator issued on Dec. 18, 1990 to A. Pocrass, a connector adapted to receive a mating plug therein has a visual indicator positioned within the front wall and thus integral with the housing to provide a visual verification of the status of the electrical connection. However, because the visual indicator is formed integral with the housing, it is not possible to change the indicator light should it need replacing.

In U.S. Pat. Nos. 4,379,606 and 4,397,513,both entitled Cartridge Holder and Connector System issued on Apr. 12, 1983 and Aug. 9, 1983 respectively to Clark et al., discloses a cartridge holder that is adaptable to receive different cartridge configurations through a removable front plate keyed to the specific cartridge configuration. The front plate is detachably secured to the housing so that by replacing the front plate, the housing is adapted to receive different cartridge configurations. However, while the front plate includes apertures to view the LEDs, the LEDs are retained in proper position by the cartridge housing. The cartridge housing in turn, is then secured to the circuit board.

Thus, with the '606 and '513 Clark et al. patents it would be necessary to totally remove the holder or housing from the printed circuit or mounting board in order to change or replace the LEDs.

In view of the above, it is thus an object of the present invention to provide a multiple modular jack that includes integral indicator lights.

It is another object of the present invention to provide a multiple modular jack with removable indicator lights.

It is yet another object of the present invention to provide a multiple modular jack with a readily removable front panel and removable indicator lights that does not change the profile of a standard multiple modular jack.

SUMMARY OF THE INVENTION

The above objects are achieved in the present invention with the provision of a multiple modular jack having indicator lights detachably retained by the front shield, face plate, or bezel of the jack. The front shield is detachably mounted to the front face of the housing. The placement of the indicator lights on the front shield does not alter the profile of a standard multiple modular jack, and thus no modification to the housing is necessary to carry out the present invention.

In one embodiment, the front shield includes bracket portions that have bores therein. The bores removably receive and retain the indicator lights, with the front shield held onto the housing. Retention of the indicator lights is thus accomplished solely by the front shield, independent of the housing. Preferably, the indicator lights are light emitting diodes (LEDs). This embodiment is practical for small LEDs such as 1.8 mm LEDs.

In another embodiment, the front shield includes bracket portions with notches formed therein. The edges of the notches are received in grooves formed in the LEDs. This embodiment is practical for larger LEDs such as 3.0 mm LEDs.

Generally, the LEDs include terminals that are electrically coupled to circuits on the printed circuit board. Alternatively, the LEDs may be coupled to terminal pins that are electrically coupled to the appropriate circuits on the circuit board via a thin, flexible conductor that extends about the housing of the jack.

In yet another embodiment, the LEDs may be directly coupled to a flex circuit without a front plate, the flex circuit wrapping around the housing of the jack and coupled to the printed circuit board. The flex circuit may, for example, be a copper etched circuit or a thin film type conductor circuit.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments. Reference the appended drawings, wherein.

DETAILED DESCRIPTION

Figure 1:
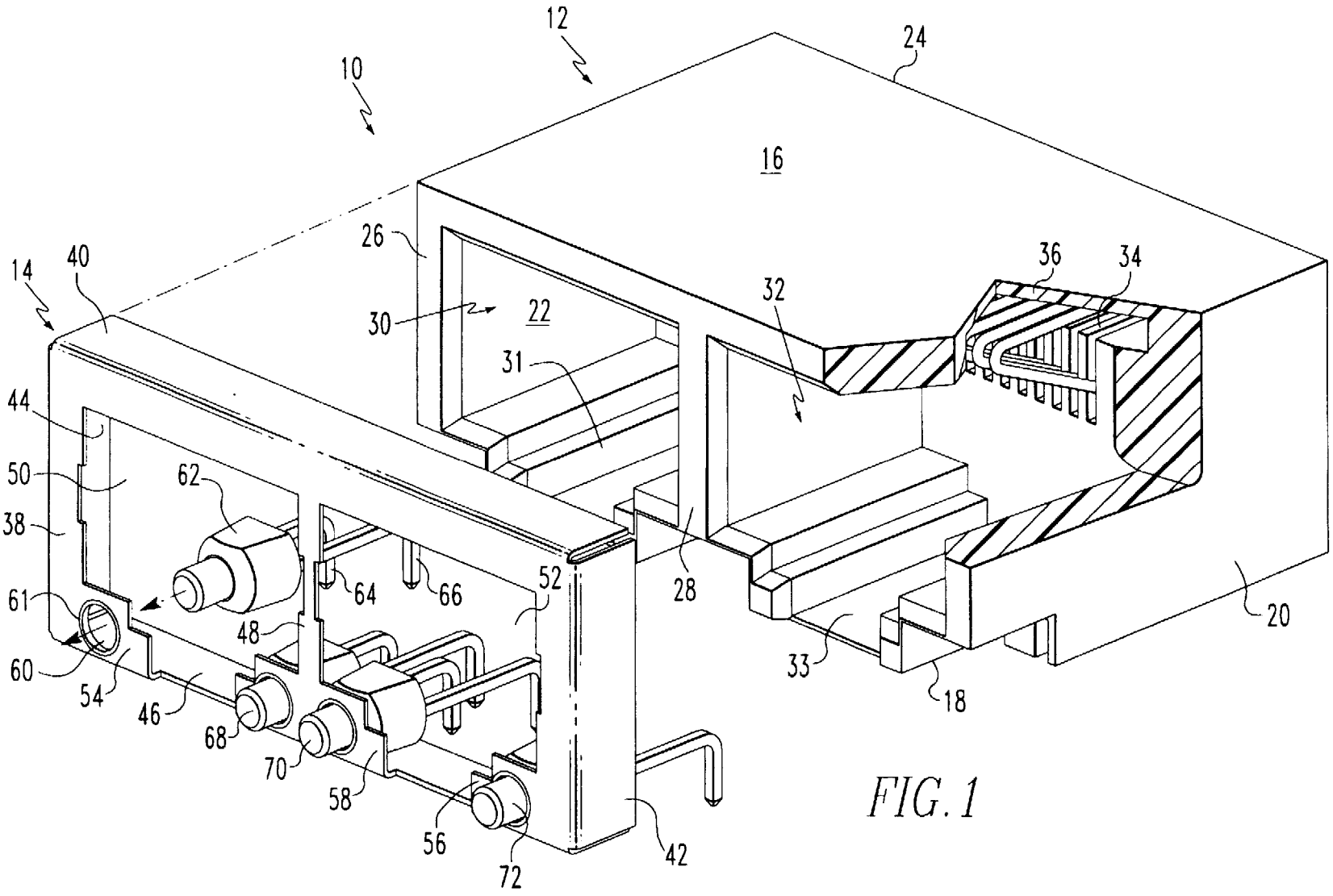
FIG. 1 is an exploded perspective view of a dual opening modular jack with the housing in partial cutaway, the jack having a removable face plate adapted to removably retain a plurality of LEDs.

Referring to FIG. 1, there is shown a dual receptacle modular jack, generally designated 10. The modular jack 10 includes a housing, generally designated 12, and a front cover, shield, or face plate, generally designated 14. The housing 12 is essentially hollow and defined by a top wall 16, a bottom wall 18, a right side wall 20, a left side wall 22, a rear wall 24, and a front wall 26. Preferably, the housing is molded from an electrically insulating or dielectric material such as plastic, but any suitable material may be used. The modular jack 10 depicted in FIG. 1 has a middle partition, divider, or wall 28 that defines a left cavity 30 and a right cavity 32 within the housing 12. Integrally formed into the housing 12 at the bottom of the left cavity 30 is a channel formation 31 that serves to orient and guide the receiving plug (not shown) through a complementary plug structure (not shown). Likewise, integrally formed into the housing 12 at the bottom of the right cavity 32 is a channel formation 33 that serves the orient and guide the receiving plug (not shown) through a complementary plug structure (not shown). It should be understood that while the modular jack 10 depicted in FIG. 1 is configured for the receipt of two complementary plugs, the principles of the present invention as described herein are applicable to single modular jacks as well as multiple position modular jacks (gang jacks).

Disposed in the rear wall 24 at the end of the right cavity 32 is a plurality of slots or openings 34. One terminal or lead 36 extends through each slot 34 in a one-to-one correspondence. The number of slot/terminal pairs 34/36 depends on the design of the jack and the available space. Typically, four or more slot/terminal pairs 34/36 are used. While not viewable in FIG. 1, disposed in the rear wall 24 at the end of the left cavity 30 are like slot/terminal pairs. The number of slot/terminal pairs at the end of the left cavity 30 is generally the same as for the right cavity 32.

According to one aspect of the present invention, the face plate 14 is adapted to be removably or detachably received against the front wall 26 of the modular jack 10. Preferably, the face plate 14 is made of a suitable electrically conducting metal. In this manner, the face plate 14 serves as a metal shield for electrical grounding for devices attached thereto or mounted thereon. The face plate 14 is defined by a front face 38, a top flange 40, a bottom flange 46, a right flange 42, and a left flange 44. Each flange 40, 42, 44, 46 extends a short distance from and transverse relative to the front face 38 such that when the face plate 14 is positioned against the housing 12, the flanges are adjacent respective walls 16, 20, 22,18 and hold the face plate 14 to the housing 12 by an interference or friction fit.

The front face 38 includes a left cutout portion 50 and a right cutout portion 52 that correspond in location and dimension to the left and right openings 30, 32, respectively, to allow the plug (not shown) to fit therethrough and into the respective left and right cavities 30, 32. The front face 38 also includes a left bracket 54, a right bracket 56, and a middle bracket 58 each of which are disposed at the bottom of the front face 38. The brackets 54, 56, 58 correspond in location to cutout areas in the housing 12. The bracket 54 has a bore 60 with an insert or grommet 61 therein. Disposed in the bore and removably retained by the insert 61 is a light emitting device such as a light emitting diode (LED) 62. The LED 62 shown is a 1.8 mm LED having two leads or terminals 64, 66 that are electrically coupled to a particular line circuit for status indication of that particular line. The middle bracket 58 includes two like bores (not numbered) and inserts (not numbered) that removably retain two 1.8 mm LEDs 68, 70. In like manner, the right bracket 56 includes a bore (not numbered) and insert (not numbered) that removably retains a 1.8 LED 72. Of course, each LED 68, 70, 72 also includes two terminals (not numbered) associated therewith for electrical connection to a particular line circuit.

It should be understood that the housing 12 is a standard dual receptacle modular jack housing and thus needs no modification to accommodate the present detachable face plate 14 with its removable LEDs 62, 68, 70, 72. The 1.8 mm LEDs are shielded against static discharge by the face plate 14.

Figure 2:
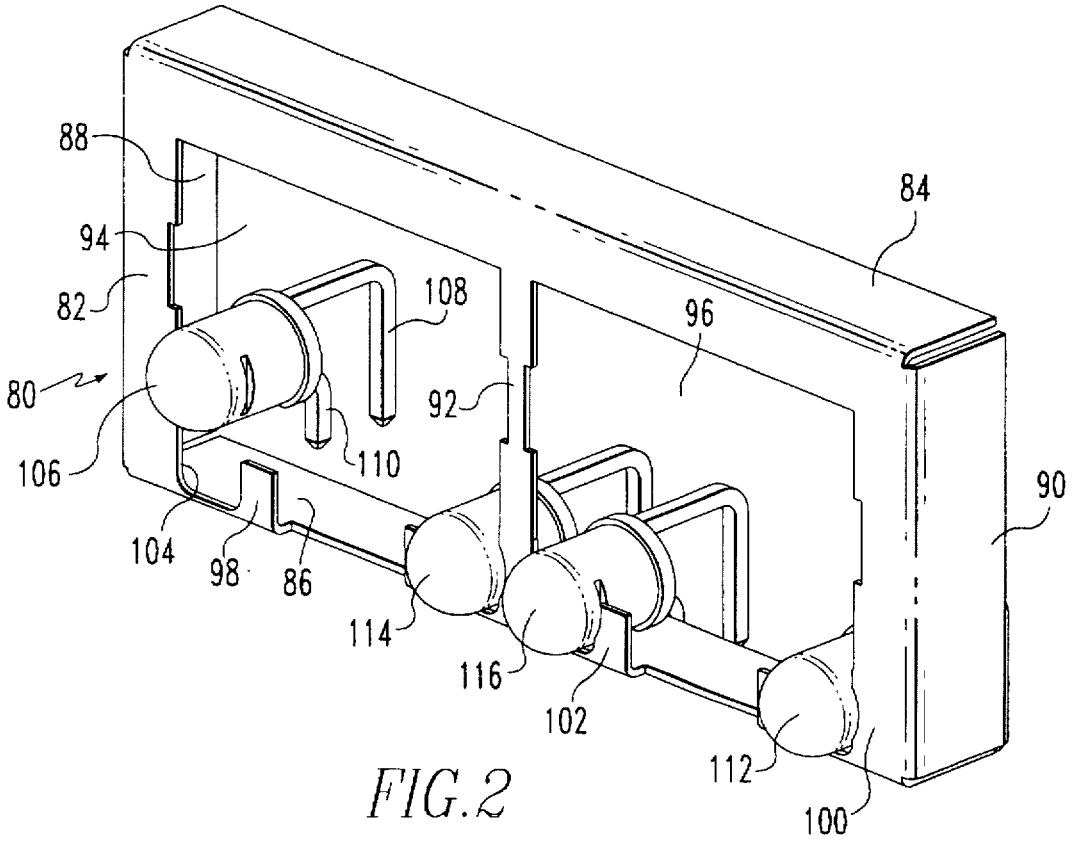
FIG. 2 is a perspective view of an alternative embodiment of a removable face plate for the modular jack of FIG. 1, the face plate adapted to removably retain a plurality of alternative type LEDs.

With reference now to FIG. 2, there is shown an alternative embodiment of a face plate and associated light indication or emitting devices. The face plate 80 is, again, preferably made of an electrically conducting metal to provide a metal shield or path for static discharges, and is designed to be detachably attached to the housing 12 without modification to the housing. The face plate 80 is defined by a front face 82, a top flange 84, a bottom flange 86, a left flange 88, and a right flange 90. The flanges 82, 84, 86, 88, 90, extend a short distance from and transverse relative to the front face 82 such that when the face plate 14 is positioned against the housing 12, the flanges are adjacent respective walls 16, 20, 22, 18 and hold the face plate 80 to the housing 12 by an interference or friction fit.

The face plate 80 additionally includes a center partition 92 that defines left and right cutout portions 94 and 96 respectively. The left and right cutout portions 94 and 96 correspond in location and dimension to the left and right cavities 30, 32, respectively, to allow the plug (not shown) to fit therethrough and into the respective left and right cavities 30, 32. The front face 82 also has a left bracket 98, a right bracket 100, and a middle or center bracket 102 each of which are disposed at the bottom of the front face 82. The brackets 98, 100, 102 correspond in location to cutout areas in the housing 12. The left bracket 98 has a configured notch 104 therein in which is removably seated a light emitting device such as a light emitting diode (LED) 106 via grooves in the lens of the LED 106 that hold the edges of the configured notch 104. Additionally, the LED 106 has two leads 108, 110 for electrically coupling the LED 106 to a particular line circuit for status or trouble indication of that particular line. The right bracket 100 likewise includes a configured notch (not numbered) in which is disposed an LED 112, while the middle bracket 102 includes two configured notches (not numbered) in which are disposed LEDs 114 and 116. Although not numbered, or particularly seen in FIG. 2, each LED includes two leads for electrically coupling the particular LED to the particular line or circuit.

As depicted in FIG. 2, the LEDs 106, 112, 114, and 116 are 3.0 mm LEDs. The 3.0 mm LEDs provide an increased indicator size relative to the 1.8 LEDs that is somewhat more noticeable when illuminated. However, the increased size of the LED is at the expense of a face plate having less metal per the total are thereof. It should now be understood that any color of LED may be used as well as size of LED as long as the supporting brackets can accommodate the particular size. The larger the size of LED, the less metal in the face plate and thus the less shielding the face plate provides against static discharge. The more metal the face plate has, the more the face plate can dissipate the static discharge reducing the likelihood of damage to the LED. With less metal area, the ability of the plate to absorb or dissipate the electricity is reduced.

Figure 3:
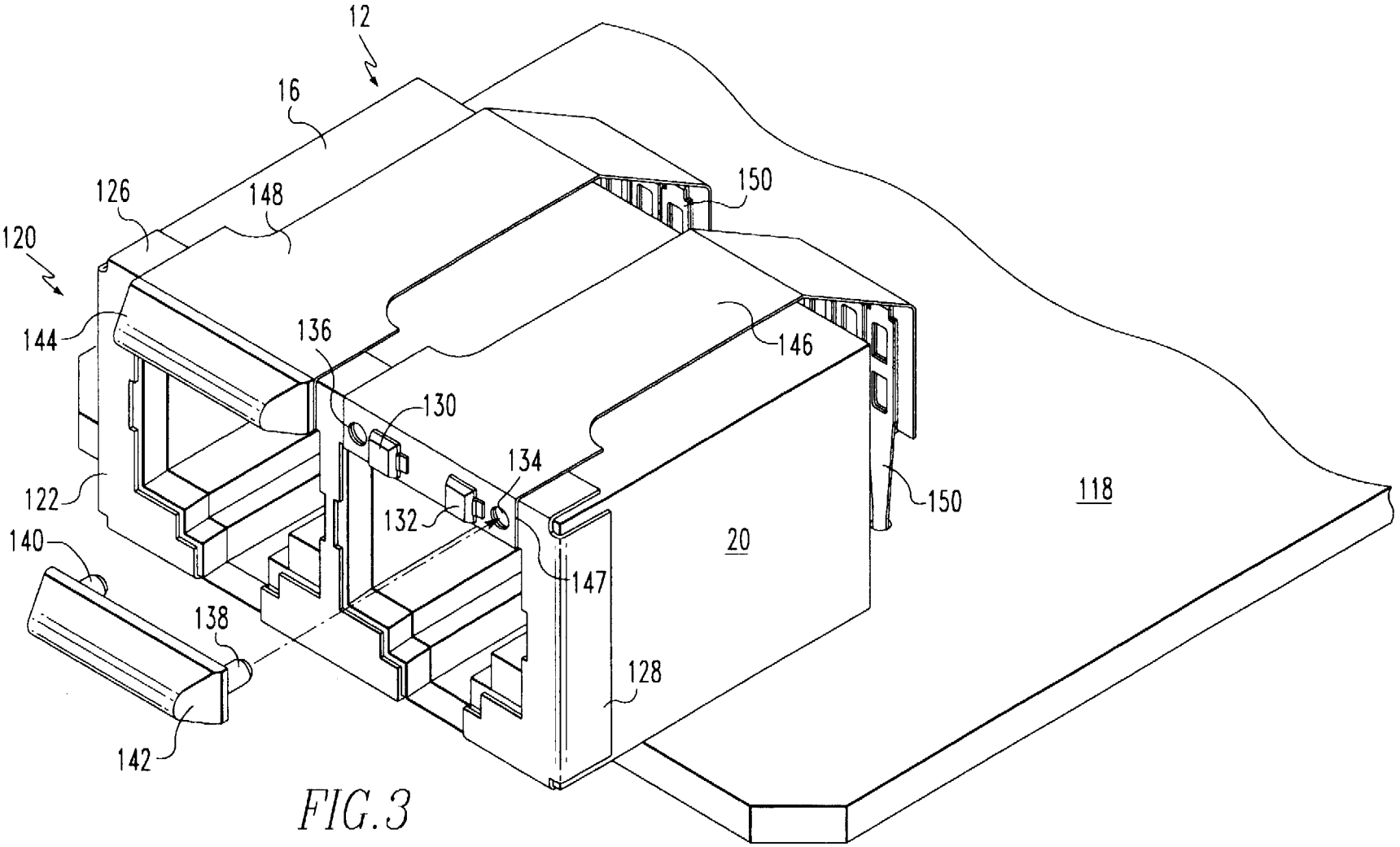
FIG. 3 is a perspective view of the modular jack of FIG. 1 mounted onto a printed circuit board, the modular jack having another alternative embodiment of a detachable face plate adapted to removably retain a plurality of another alternative type of LEDs coupled to the circuit board by ribbon leads or a thin film conductor strip.
Figure 4:
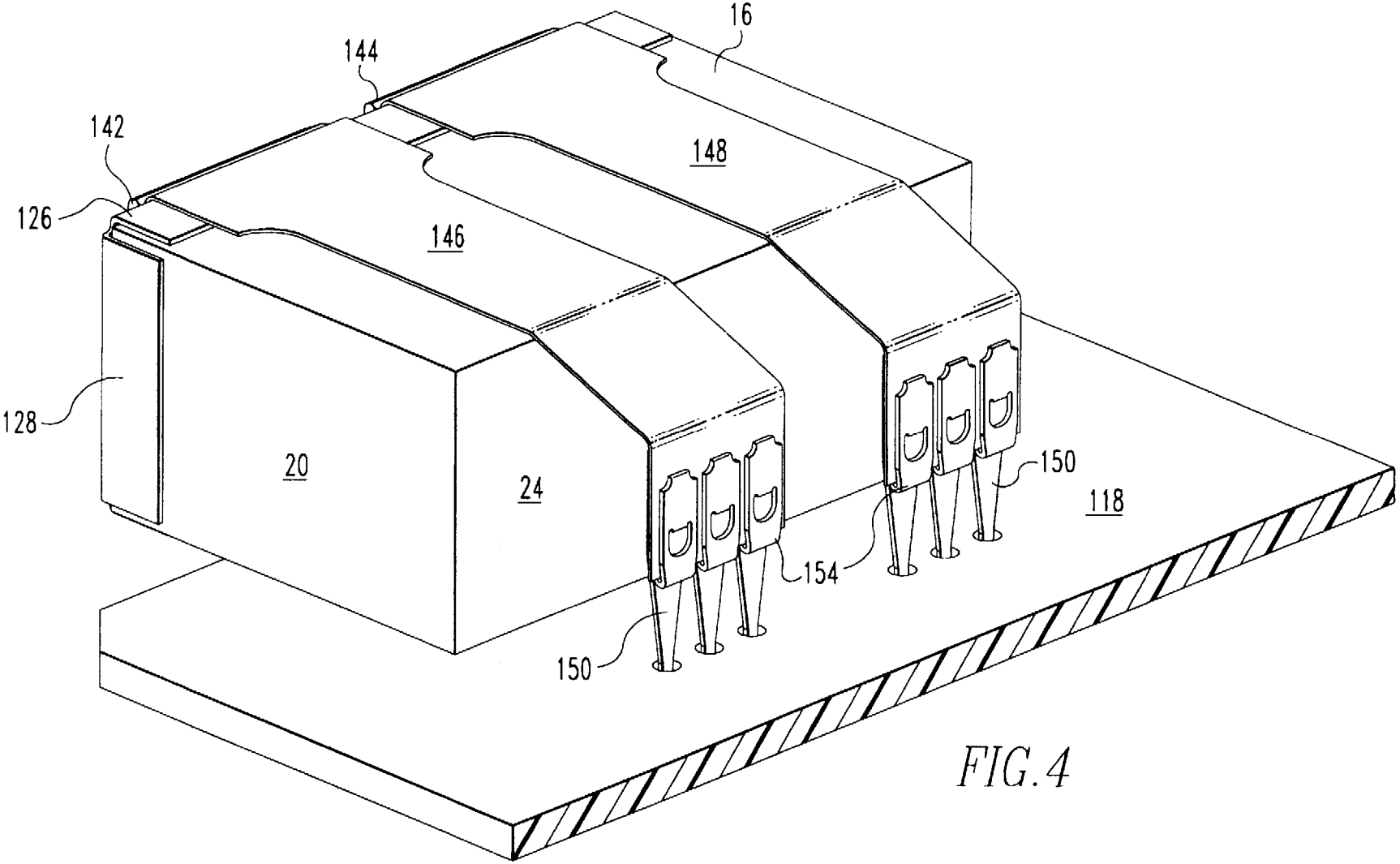
FIG. 4 is a rear perspective view of the modular jack of FIG. 3.

With reference to FIGS. 3 and 4 there is shown a further alternative embodiment of a face plate and LED configuration. Here, the housing 12 is shown mounted upon a printed circuit board (PCB) 118. The face plate 120, in like manner to the previous embodiments depicted in FIGS. 1 and 2, includes a front face 122, a bottom flange 124, a top flange 126, a right flange 128, and a left flange (not visible) that each extend a short distance from and transverse to the front face 122 that together provides an interference fit with the sides or walls of the housing 12 in order to detachably secure the face plate 120 to the housing 12. The present face plate 120 has two light emitting devices such as light emitting diodes (LEDs) per each housing cavity or receptacle that are mounted to the upper portion of the front face 122, in contrast to the face plates 14 and 80 of FIGS. 1 and 2, respectively.

For illustration, two LEDs 130 and 132 are depicted for the right receptacle of the housing 12, with a lens 142 in an exploded position. The LEDs 130, 132 are electrically coupled to an end 147 of a thin, flexible conductor strip 146, such as a ribbon cable, a thin film coated conductor, a copper etched circuit, or the like and may be coupled to the housing by adhesive. The end 147 and the upper portion of the front face 122 also includes two bores 134, 136 that receive two legs 138, 140 of the elongated lens 142. The lens 142 helps retain the conductor strip 146 on the housing 12 and soften the LED light effect. In like manner to the right receptacle side of the housing, the left receptacle side includes two LEDs (not shown) electrically coupled to a thin, flexible conductor strip 148, and covered by a lens 144. The conductor strips 146, 148 are contiguous with the top wall 16 of the housing 12 and are electrically coupled to a plurality of terminal pins 150 that are in turn electrically coupled to the appropriate circuits on the PCB 118. One type of terminal pin 150 may be a Clincher Solder Tab obtainable through Berg Electronics of Etters, Pa. as part number 76216.

As best seen in FIG. 4, the terminal pins 150 are used to electrically couple or act as a bridge between the various circuits of the conductor strips 146, 148 and the appropriate PCB 118 circuits. The strip 146 is retained by a U-portion 154 of the terminal pin 150.

It should be understood that with the use of a flex circuit it is not necessary to have a face plate. The LEDs may be mounted directly to the flex circuit. Additionally, the flex circuit may comprise as many electrical circuits as necessary to accommodate the number of LEDs.

While the foregoing is directed to the preferred embodiment of the present invention, other and further embodiments of the invention may be devised without departing from the basic scope thereof, and the scope thereof is determined by the claims which follow.

What is claimed is:

1. In a modular type connector for receiving a complementary plug to effect an electrical connection between the modular connector and the plug, the modular connector having a housing defining a front face with a cavity therein, the modular connector further having a plurality of terminals extending into the cavity and adapted to make electrical contact with corresponding terminals on the plug, the improvement comprising a cover plate removably secured to the front face of the connector, the cover plate having a cutout portion conforming in shape to the cavity in the modular connector, and a light emitting device removably retained on said cover plate, said light emitting device adapted to be electrically coupled by means of flex circuits disposed on an exterior surface of the housing to one of the terminals to indicate status of that terminal.

2. The modular connector of claim 1, wherein the housing is formed by a top wall, a bottom wall, a right side wall, a left side wall, and a rear wall.

3. The connector of claim 1, wherein the flex circuits comprise a polyester film with a conductive ink.

4. The connector of claim 3, wherein the flex circuits are coupled to a solder tab.

5. The modular connector of claim 2, wherein said cover plate comprises a flat front panel with said cutout portion therein, said flat front panel conforming in size to the front face of the housing and including an upper transverse meber extending from an upper end of said front panel and adapted to abut an outer surface of the top wall and cover a portion thereof, a lower transverse member extending from a lower end of said front panel and adapted to abut an outer surface of the bottom wall and cover a portion thereof, a left transverse member extending from a left end of said front panel and adapted to abut an outer surface of the left side wall and cover a portion thereof, and a right transverse member extending from a right end of said front panel and adapted to abut an outer surface of the right side wall and cover a portion thereof.

6. The connector of claim 1, further comprising a lens removably received on said cover plate and disposed over said light emitting device.

7. A modular connector for receiving a complementary plug to effect an electrical connection therebetween, the modular connector comprising:

a housing defining a front face and having a cavity therein with an opening in said front face;

a plurality of electrical terminals disposed within said cavity and adapted to be electrically coupled to complementary electrical terminals of the plug upon insertion of the plug into said cavity;

a flex circuit electrically coupled to at least one of said plurality of electrical terminals; and a light emitting device electrically coupled to said flex circuit wherein a portion of said flex circuit is secured to said housing and a lens is superimposed over said light emitting device and said flex circuit is secured at least in part to said housing by said lens.

8. The modular connector of claim 7, further comprising a plurality of light emitting devices of a number equal to or less than said plurality of electrical terminals, each said light emitting device electrically coupled to one of a plurality of flex circuits.

9. The modular connector of claim 7, wherein said housing has a rear side opposed to said front face and said flex circuit extends rearwardly beyond said rear side.

* * * * *